United States Patent [19]

Smith

[11] Patent Number: 4,872,577

[45] Date of Patent: Oct. 10, 1989

[54] HINGED CLOSURE ATTACHMENT FOR INSULATED BEVERAGE CAN CONTAINER

[76] Inventor: Jimmy L. Smith, R.R. 3, Geneso, Ill. 61254

[21] Appl. No.: 289,135

[22] Filed: Dec. 23, 1988

[51] Int. Cl.[4] ..... B65D 43/14

[52] U.S. Cl. ..... 220/85 CH; 220/264; 220/343; 220/903

[58] Field of Search ..... 220/85 H, 85 CH, 90.2, 220/90.4, 90.6, 263, 264, 343, 903

[56] References Cited

U.S. PATENT DOCUMENTS

| | | | |
|---|---|---|---|
| 1,503,187 | 7/1924 | Fitchett | 220/343 X |
| 3,023,922 | 3/1962 | Arrington et al. | 220/903 X |
| 3,905,511 | 9/1975 | Groendal | 220/90.2 |
| 4,282,279 | 8/1981 | Strickland | 220/903 X |
| 4,401,245 | 8/1983 | Zills | 220/903 X |
| 4,494,672 | 1/1985 | Pearson | 220/85 H X |
| 4,690,300 | 9/1987 | Woods | 220/90.4 X |
| 4,735,333 | 4/1988 | Lay et al. | 220/90.2 |
| 4,752,016 | 6/1988 | Eads | 220/90.2 X |

*Primary Examiner*—Jimmy G. Foster
*Assistant Examiner*—Nora Stucker
*Attorney, Agent, or Firm*—Henderson & Sturm

[57] ABSTRACT

The disclosed closure attachment comprises a band for tightly encircling the upper marginal edge of a beverage can container of the foam-insulated type, and the band carries an insulated hinged lid mounted on the band for selective positioning between open and closed modes. The hinge includes a spring for biasing the lid to closed position. The band is adjustable as to diametrical size so as to be adapted to containers of different diameters.

1 Claim, 1 Drawing Sheet

HINGED CLOSURE ATTACHMENT FOR INSULATED BEVERAGE CAN CONTAINER

BACKGROUND OF THE INVENTION

Insulated beverage can containers of course are well known, especially of the type dimensioned to telescopically receive a metal beverage can in an arrangement in which the upper marginal edge of the can projects somewhat above the top of the insulated container to facilitate consumption of the contents. Conventionally, such can containers are without lids and thus the beverage can is exposed to ambient contamination; e.g., dust, insects and the like.

The present invention is an improvement in the use of insulated can containers by the provision of an attachment closure that includes a lid and means for mounting the lid on the container, which means includes a hinge whereby the lid may be opened and closed. The means mounting the lid on the can features an annular band for removably encircling the insulated container about its marginal upper edge. The band is adjustable as to size and thus adapted to fit containers of different diameters. The lid is of insulating material to match that of the container. The lid is easily opened and closed, and the entire attachment is of sturdy design and low-cost construction capable of use over an extended period of time.

Further features and advantages of the invention will become apparent as a preferred embodiment of the invention is disclosed in the ensuing description and accompanying drawing.

DETAILED DESCRIPTION OF A PREFERRED EMBODIMENT OF THE INVENTION

Figure 1:
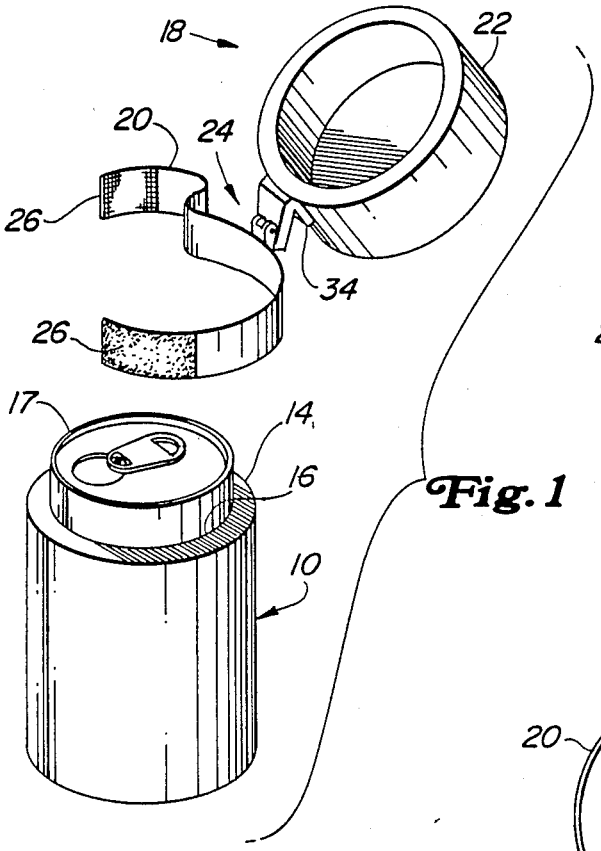
FIG. 1 is an exploded perspective of a typical insulated beverage can container in association with the improved closure attachment.
Figure 2:
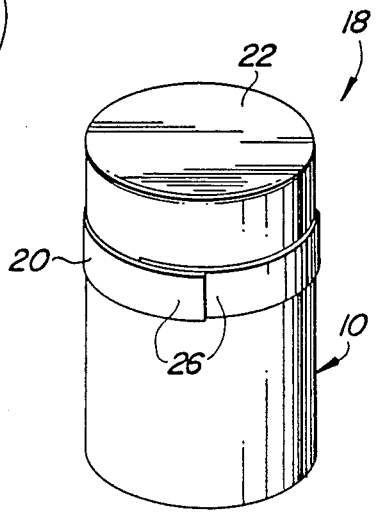
FIG. 2 is a perspective of the closure assembled to the can and showing the lid in closed position.
Figure 3:
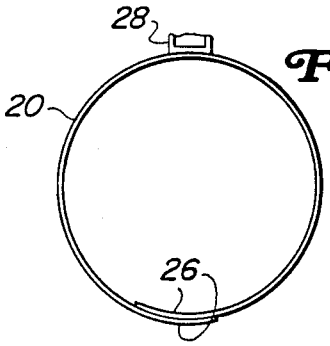
FIG. 3 is a plan of the closure attachment band.
Figure 4:
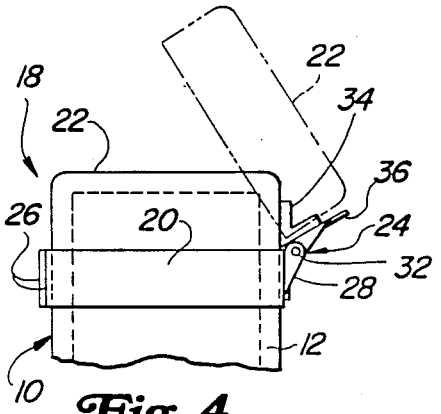
FIG. 4 is a fragmentary elevation showing the attachment mounted on the beverage can, the closed position of the lid being shown in full lines and the open position in broken lines.
Figure 5:
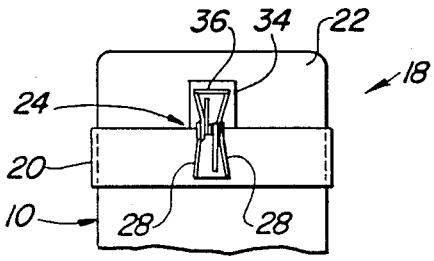
FIG. 5 is an elevation as seen at ninety degrees to FIG. 4.

The numeral 10 designates a typical insulated beverage can container having an annular wall 12 terminating in an upper marginal edge 14 defining an open top 16 into which a beverage can 17 is telescopically downwardly insertable. The closure attachment is labeled 18 in its entirety and comprises essentially an annular band means 20, a lid 22 of insulating material to match that of the container 10 and hinge means 24 mounting the lid on the band. The lid is in the form of a low-profile inverted cup and is diametrically dimensioned to overlie the top of the marginal edge of the container 10 when in closed position and thus fits over the exposed upper edge of the beverage can.

The band may be of any suitable material and is configured to tightly encircle the marginal edge of the container. In the present case, the overlapping ends 26 of the band may include any suitable form of connect-disconnect means such as hook and loop means; e.g., the product known by the name "Velcro"; although, any suitable equivalent may be used. Further the band or portions thereof may be elastic so as to improve the grip of the band on the container. Because of the nature of the band in any event, it is adjustable as to size and thus adapted to fit containers of different diameters, thus enhancing its versatility. Normally, because most beverage cans are of the same diameter it is mainly the outer diameter of container that may vary according to the thickness of the container wall.

Figure 6:
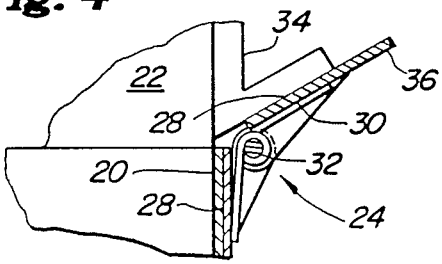
FIG. 6 is an enlarged view of the hinge, particularly showing the spring for biasing the lid to closed position.

A further feature of the invention is that the hinge means, made up of upper and lower hinge leaves 28, includes a spring 30 (FIG. 6) wrapped about a hinge pivot 32 for biasing the lid to closed position. The hinge leaves 28 are secured respectively to the lid and band by any suitable means such as appropriate cement so as to become an integral part of the attachment, and the upper leaf cooperates with a projection 34 on the lid to provide a thumb part 36 for easily opening the lid.

As will be seen from the foregoing, the attachment is simple and may be easily manufactured in unit from for adaptation to existing beverage can containers or may be distributed as part of container packages. The low cost, ease of use and long life are significant benefits to be derived from the attachment. Features and advantages other than those pointed out herein will become readily apparent to those versed in the art, as will many variations in the preferred embodiment of the invention disclosed herein, all without departure from the spirit and scope of the invention.

I claim:

1. A closure attachment for an insulated container having an annular wall terminating in an upper marginal edge providing an open top for receiving a beverage can wherein the height of the wall is less than that of the can whereby an upper cylindrical portion of the received can is exposed above the aforesaid marginal edge, said attachment comprising annular band means configured to tightly encircled the insulated container wall below the aforesaid marginal edge and independently of the beverage can, an imperforate lid dimensioned to fit over the open top of the insulated container, said lid being in the form of an insulated inverted cup configured to overlie the top of the insulated container wherein closed position and additionally to snugly fit over the enclose the exposed upper portion of the beverage can, and hinge means connecting the lid to the band means.

* * * * *